US005189769A

United States Patent [19]

Shoesmith

[11] Patent Number: 5,189,769

[45] Date of Patent: * Mar. 2, 1993

[54] MANUFACTURE OF A MULTIPLE BIASED FABRIC BY FOLDING

[75] Inventor: Roy Shoesmith, Ontario, Canada

[73] Assignee: Bay Mills Limited, Ontario, Canada

[ * ] Notice: The portion of the term of this patent subsequent to Feb. 5, 2008 has been disclaimed.

[21] Appl. No.: 531,643

[22] Filed: Jun. 1, 1990

Related U.S. Application Data

[63] Continuation-in-part of Ser. No. 377,171, Jul. 10, 1989, Pat. No. 4,989,529.

[51] Int. Cl.[5] ..... D03D 1/00; D05B 1/00; B32B 5/00

[52] U.S. Cl. ..... 28/158; 28/157; 112/262.1; 112/147; 156/177; 156/204; 156/226; 156/443

[58] Field of Search ..... 28/158, 157, 100; 112/137, 138, 152, 10, 147, 262.1, 262.3, 401, 402, 412, 415, 416, 417, 420, 424; 156/177, 204, 226, 454, 443

[56] References Cited

U.S. PATENT DOCUMENTS

| | | | |
|---|---|---|---|
| 893,356 | 7/1980 | Nelke | 28/157 |
| 1,607,266 | 11/1926 | Laugh | 28/157 X |
| 3,013,513 | 12/1961 | Judelson . | |
| 3,459,615 | 8/1969 | Eilerman | 156/181 |
| 3,564,872 | 2/1971 | Klaeüi . | |
| 3,623,927 | 11/1971 | Watson | 28/158 X |
| 3,819,469 | 6/1974 | Balch et al. | 428/112 |
| 4,081,305 | 3/1978 | Patin | 156/204 |
| 4,484,459 | 11/1984 | Hutson | 156/439 |
| 4,567,738 | 2/1986 | Hutson et al. . | |
| 4,989,529 | 2/1991 | Shoesmith | 112/147 |

FOREIGN PATENT DOCUMENTS

| | | |
|---|---|---|
| 0282471 | 9/1988 | European Pat. Off. . |
| 1435115 | 4/1969 | Fed. Rep. of Germany . |
| 2271326 | 12/1975 | France . |
| 2540847 | 8/1984 | France . |

*Primary Examiner*—Werner H. Schroeder
*Assistant Examiner*—Bibhu Mohanty
*Attorney, Agent, or Firm*—Fitzpatrick, Cella, Harper & Scinto

[57] ABSTRACT

A method of making a multi-layer non-woven multiple biased fabric is disclosed. A layer of fabric is directed in a longitudinal direction of travel, wherein the layer of fabric is comprised of a plurality of structural fibers oriented substantially parallel to each other and oriented at an angle to the longitudinal center line of the fabric. The layer of fabric may or may not be previously biased. If not previously biased, then the structural yarns of the fabric are biased in a biasing stage to form a layer of single bias structural fabric having the structural fibers biased to the fabric centerline. The single biased fabric layer is led into at least one folding stage for folding the biased layer longitudinally from one edge toward another to form a multiple biased fabric. The multiple biased fabric is led from the at least one folding stage into an affixing stage for affixing the multiple biased fabric together to provide a single structural fabric being multiple biased.

22 Claims, 3 Drawing Sheets

MANUFACTURE OF A MULTIPLE BIASED FABRIC BY FOLDING

This application is a continuation-in-part of U.S. patent application Ser. No. 07/377,171 filed Jul. 10, 1989 now U.S. Pat. No. 4,989,529.

BACKGROUND OF THE INVENTION

1. Field of the Invention

The present invention relates to a process and apparatus for making a unitary structural fabric at least double biased and, more particularly, for making a fabric of two or more layers with at least one of the layers being single biased. The invention also relates to the fabric made.

2. Description of the Related Art

Structural fabrics have a wide variety of applications wherever high strength is required, but weight must be kept to a minimum. The aerospace, marine and automobile industries, to name a few, frequently employ industrial fabrics made up of many layers of structural fibers saturated with cross-linked and hardened resin as high strength materials to form composites. The layers of the composites may be biased in directions to maximize the strength of the overall product, frequently in the direction of strongest applied tension or strain.

By biased, it is intended to mean that the structural fibers of any particular layer are substantially oriented at an angle other than zero or ninety degrees to the major axes of the fabric composite (i.e., longitudinal and lateral centerlines).

One technique for forming such a fabric or composite is disclosed in U.S. Pat. No. 4,484,459 drawn to a biased multi layer structural composite stitched in a vertical direction. The fabric is made up of three layers of parallel structural fibers with at least one of the layers being biased. The layers are maintained by vertical stitching only, with no horizontal threads being present in the composite.

This type of fabric may be formed using an apparatus which consists of two or more weft lay down carriage mechanisms each aligned with a vertical stitching machine. The lay down carriage mechanisms are each oriented transversely to a device for advancing the fibers delivered therefrom into a stitching machine. At least one of the lay down carriages is oriented at an angle to the fiber advancing device and stitching machine, such that, when fibers are laid down in parallel array by each of the lay down carriages, the fibers of each are deposited on the fibers of the immediately preceding lay down carriage mechanism and are advanced into the stitching machine. The fibers from the angled lay down carriages are parallel biased with respect to the major axes of the fabric. In the stitching machine, a vertical stitch is passed between the fibers of each layer through the layers, sufficient to maintain the layers in vertical array and the fibers within each layer in parallel array. When desired, the fabric may be saturated with resin, which is subsequently cured, producing a composite.

An advantage of the '459 system is that a fabric or composite made up of two or more layers may be made with only one knitting stage. However, a disadvantage results in the complexity of the equipment used. At least one lay down carriage is necessary for each layer of fabric with each layer independently being fed into the stitching machine. Separate lay down carriages are oriented or angled with respect to the face of the stitching machine such that fibers are laid down in a parallel array, but at an angle with respect to the angle of each of the lay down carriages. Thereby, when the fibers enter the stitching machine, they too are oriented at an angle to the longitudinal center line of the fabric being formed, thus creating the biased layer. Although this process uses only one knitting stage, the use of many lay down carriages creates a machine that is complicated and costly.

A need, then, has arisen to manufacture a double biased fabric using much simpler apparatus as well as the development of an improved fabric resulting from such a process.

Another technique for producing a structural fabric and the resulting fabric is disclosed in U.S. Pat. No. 4,567,738 which relates to biased, structural fabrics to be used in reinforcing plastic shapes. The fabrics are made up of (i) structural yarn for strength and (ii) secondary yarn which holds the structural yarns parallel to each other. The secondary yarn is described as flexible and of much smaller cross section than the structural yarn. Two separate layers of fabric are used with each having its own secondary yarn for support. Further, a complicated skewing process is used to offset the bias of at least one of the fabric layers to enhance structural integrity. However, in so doing, uniformity is lost in the resulting fabric.

The method of making the fabric in the '738 patent involves directing a first layer of structural fabric into a pair of counter-rotating rollers in contact with each other such that the longitudinal centerline of the first layer is perpendicular to the longitudinal axis of the rollers. The first layer also comprises secondary holding fibers for maintaining the structural fibers in parallel alignment.

The first layer is led from the counter-rotating rollers into a stitching machine at an angle skewed from the original angle of orientation of the first layer. Simultaneously, a second layer of structural fabric is led into the stitching machine in a fashion such that the centerline of the second layer is perpendicular to the transverse axis of the stitching machine. The second layer of structural fabric is also comprised of a plurality of structural yarns substantially perpendicular to the centerline, and possibly also comprises structural yarns parallel to the centerline of the second layer with secondary holding fibers for maintaining the structural fibers in parallel alignment. The first and second layers then are stitched together in the stitching machine to provide a single structural fabric.

Accordingly, it is necessary to first knit one layer of fabric with secondary yarns then secondly, to knit a second layer of fabric with secondary yarns, then thirdly, to skew one layer of fabric for feed into the stitching machine, and finally, to knit the two layers together in the stitching machine. This process proves to be complicated in time and machinery, albeit with the result being a strong fabric. However, the skewing process results in distortions in the fabric and the array of yarns is not as uniform as may be desired.

Therefore, a need exists to produce a double biased fabric that is more uniform than that made by the skewing process of the '738 patent, yet requires less and simpler machinery than that required for knit fabric made by the process of the '459 patent. Accordingly, it is one object of the present invention to manufacture a uniform fabric having at least two layers of structural fabric, which layers are biased.

It is another object of the invention to provide a continuous process and apparatus whereby the above described fabric may be made using a noncomplicated arrangement of machinery.

These and other objects that will become apparent may be better understood by reference to the detailed description provided below.

SUMMARY OF THE PRESENT INVENTION

The present invention is directed to a multi-layer non-woven multiple fabric and to a method of making such a fabric. A layer of fabric is directed in a longitudinal direction of travel, wherein the layer of fabric is comprised of a plurality of structural fibers oriented substantially parallel to each other and oriented at an angle to the longitudinal center line of the fabric. The layer of fabric may or may not be previously biased. If not previously biased, then the structural yarns of the fabric are biased in a biasing stage to form a layer of single bias structural fabric having the structural fibers biased to the fabric centerline. The single biased fabric layer is led into at least one folding stage for folding the biased layer longitudinally from one edge toward another to form a multiple biased fabric. The multiple biased fabric is led from the at least one folding stage into an affixing stage for affixing the multiple biased fabric together to provide a single structural fabric being multiple biased.

The multi-layer biased fabric of this invention is made at least in part from a single biased layer fabric of structural yarn folded onto itself.

The single biased layer has a plurality of substantially parallel, uniaxial structural yarns oriented at an acute angle to the longitudinal centerline of the fabric. This single biased layer can be prepared by (i) laying crosswise yarns at the desired acute angle, (ii) fabricating fabric having parallel, uniaxial crosswise yarns oriented generally orthogonally to the centerline and sides of the fabric and then skewing the fabric to reorient the crosswise yarns so that they form an acute angle to the centerline of the fabric, or (iii) otherwise arranging structural yarns in parallel, yet at an angle to the centerline of the fabric. While the skewing process of (ii) results in some loss of uniformity, as discussed above with respect to the '738 patent, process (ii) may be preferred because it avoids the use of the complicated machinery necessary to lay down a single layer on a bias. Whichever process is used, the crosswise structural yarns remain essentially parallel during processing and may be held in place by sewn or knit secondary yarns, adhesive tapes, glues, resins or other temporary or permanent means or structures.

This single biased layer is then folded onto itself to form a double biased layer of the same fabric. Once folded, this double biased layer is then affixed, knit or sewn using secondary yarn or other structures to secure the fabric. A uniform double biased fabric is thus formed. Of course, any number of folding stages may be used applying the techniques of the present invention.

Further, a mat or scrim such as chopped strand mat may be added to the fabric either before or after folding. This mat may be affixed, stitched or sewn into or onto the fabric as necessary. The mat provides increased structural integrity. However, if not desired, it is not necessary to add this additional mat, for the resulting multibiased fabric of the instant invention is structurally sound, without an additional mat or scrim.

In a preferred embodiment of the invention, the structural yarn in the first layer of fabric is processed in a first stage to run at a direction approximately 45 degrees to the fabric centerline. After folding the first layer upon itself, the second layer of structural yarn runs approximately 135 degrees to the centerline. Thus, the structural yarns in the two layers cross each other at substantially ninety degree angles. The structural yarns are then held together by a secondary yarn which is either knitted or sewn, or otherwise affixed, to the structural yarns.

The present invention therefore comprises a double biased fabric of certain uniformity that is made utilizing a relatively simple process. The present invention is not limited to the specific angular orientation discussed above. Any suitable bias is possible using the techniques of this invention. Unbiased layers running at ninety or zero degrees to the centerline may also be incorporated into the fabric. Also, any number of fabric layers can be made in this invention. Accordingly, a fabric of two, three, four, or more biases can be made by applying the concepts presented herein.

A better understanding of these and other advantages of the present invention, as well as objects attained for its use, may be had by reference to the drawings which form a further part hereto and to the accompanying descriptive matter in which there are illustrated and described preferred embodiments of the invention.

BRIEF DESCRIPTION OF THE DRAWINGS

Throughout the Figures the same reference numerals designate the same or corresponding parts.

DETAILED DESCRIPTION OF THE INVENTION

Figures 1, 4:
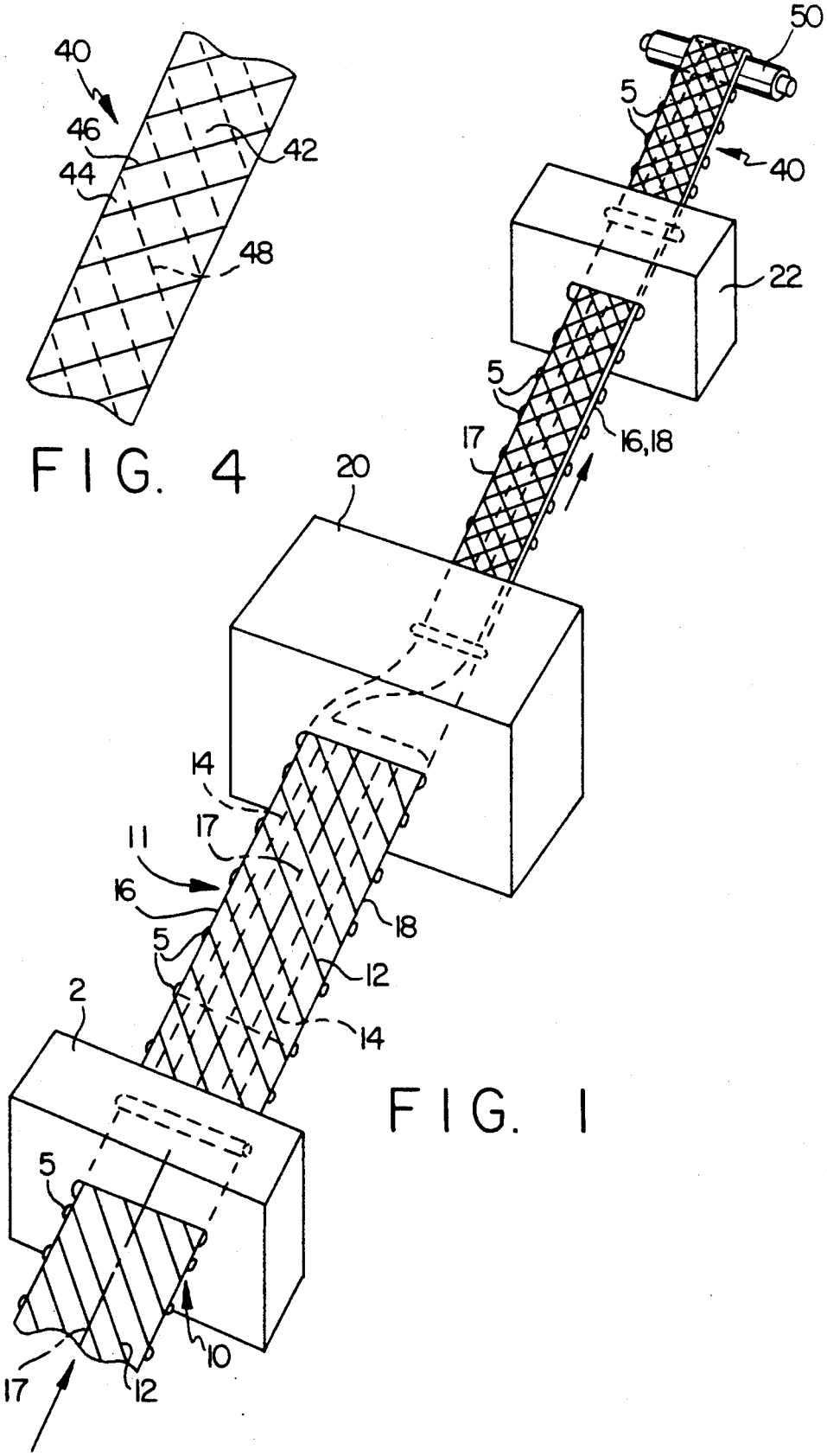
FIG. 1 is a perspective view of an apparatus of this invention, the arrows indicating the general direction of fiber/fabric advancement.
FIG. 4 is a plan view of the double biased fabric of this invention.
Figure 2:
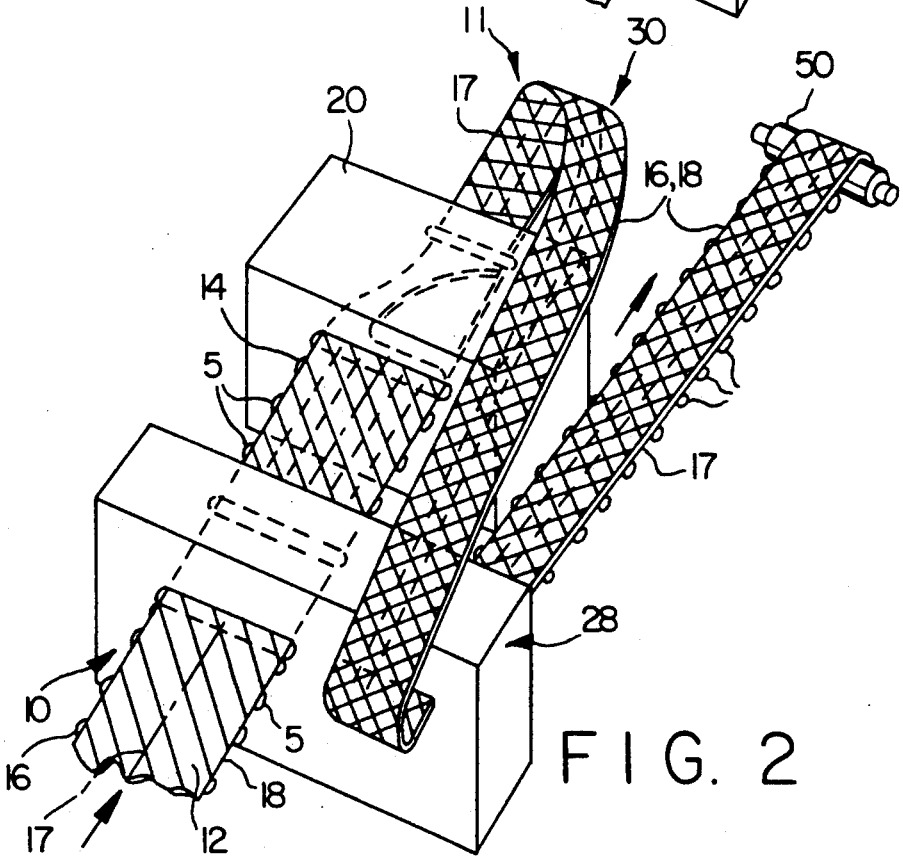
FIG. 2 is a perspective view of an alternative embodiment of this invention, the arrows indicating the direction of fiber/fabric advancement.

Single biased fabric 10 is shown in FIGS. 1 and 2. Multiple structural yarns 12 can be laid down as a series of lengths, parallel to each other at the desired angle using equipment such as shown in U.S. Pat. No. 3,564,872, biased to the longitudinal direction in which the fabric 10 is being formed. The yarns in the transversing carriage or reed of this equipment are spaced at the ends per inch required in the finished fabric. The yarn may be impaled on the pins thereof with spacing generally in the range of six to twelve inches. Reversal across the advancing pins can either be back and forth, resulting in non-parallel yarns in the fabric, or can be by lateral displacement to achieve parallel yarns. Either method may be used applying the inventive concepts of the instant invention.

The plurality of structural yarn pieces 12 shown in the Figures are spaced apart for the sake of clarity. Ordinarily, structural yarns 12 would be closer to one another than shown or even adjacent to each another. All structural yarns 12 are unidirectionally oriented and are parallel to one another. Since the structural yarns 12 are not woven, they are uniaxial. It has been found that the uniaxial feature significantly enhances the strength characteristics of the fabric 10 in the axial direction when compared with woven prior art fabrics.

As shown in FIG. 1, these structural yarns 12, carried on suitable feeders or rollers or supported on moving pin rails 5, for example, are optionally led into an affixing stage 2, such as a Liba Copcentra (trademark) where secondary or knit yarns 14 (represented by dashed lines) are added to hold the structural yarns in parallel orientation. Single biased fabric 11 is then comprised of structural yarn 12 and secondary or knit yarn 14. Affixing stage 2 can consist of a sewing, knitting, or other affixing device or process suitable to affix the structural yarns 12 in the biased manner.

Secondary yarn pieces 14 may be sewn, knitted, or otherwise affixed to structural yarn pieces 12 to hold them in place with respect to each other. Secondary yarn pieces 14 ordinarily have a significantly smaller cross-sectional area than the structural yarn pieces 12. Structural yarn pieces 12, for example, may be fiberglass or polyester generally on the order of 2000 denier, while secondary yarn pieces 14 are generally on the order of 60 denier. Secondary yarn pieces 14 ordinarily run parallel to edges 16 and 18 of the fabric 11 and are spaced apart from each other. Various knitting or sewing stitches which are commonly known to those skilled in the art may be used to secure the pieces together. Other means may be used besides knit or sewn secondary yarns. For example, adhesive tapes, frictional belts, strips or coatings of resin or glue, and the like can also be used in addition to or instead of secondary yarns 14 as means to affix the structural yarns in their parallel arrangement.

Structural yarn 12 is preferably a bundle of low or zero twist glass fibers, although any structural fibers, for example, carbon or other commercial fibers may be used. Secondary yarn 14 is preferably made from polyester or a similar material, although it need not be. Secondary yarn 14 is not structural since it is much smaller in cross-sectional area and much more flexible than structural yarn 12.

As discussed above, in addition to preparing the single biased fabric 11 by laying crosswise yarns at the desired angle and stitching them, such fabric can be prepared in other ways. For instance, fabric having parallel crosswise yarns oriented generally orthogonally to the centerline and sides of the fabric may be fabricated first. Then, such fabric may be skewed to reorient the crosswise yarns so that they form an acute angle to the centerline of the fabric. This technique is shown for example in French Patent No. 2,271,326. In that document, a woven bias fabric is formed by feeding a fabric having orthogonally oriented strands from a feed roll to a take-up roll. The axis of the take-up roll is offset from the feed roll by an acute angle. Therefore, the offset angle determines the fabric bias angle. Secondary yarns 14 shown in FIG. 1 may not be necessary. For example, if the fabric 11 is a woven fabric, the warp yarns will hold the crosswise yarns in parallel array. In such cases, however, yarns 14 may be added if desired.

Figure 5:
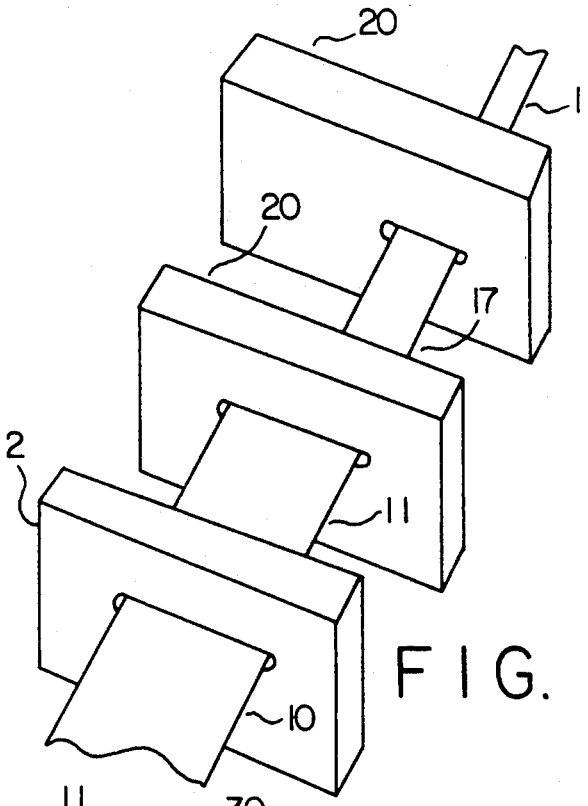
FIG. 5 is a perspective view of an apparatus of this invention, depicting a plurality of folding stages.
Figure 6:
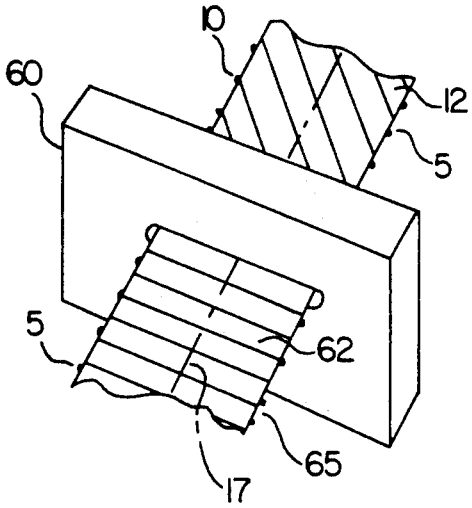
FIG. 6 is a perspective view of an apparatus of this invention, depicting a biasing stage.

As shown in FIG. 6, biasing stage 60 may be used to bias structural fabric 65 having a plurality of structural fibers 62 oriented substantially parallel to each other and oriented substantially orthogonally to the longitudinal centerline 17 of the fabric. The structural yarns 62 of the fabric 65 are biased in biasing stage 60 to form a layer of single biased fabric 10 having the structural fibers 12 biased to the fabric centerline 17. The biased fabric layer may then be led to one folding stage 20 as will be discussed below with respect to FIG. 1, or to a plurality of folding stages as will be discussed below with respect to FIG. 5.

Single biased fabric 11 prepared in any of the manners discussed above is then fed on suitable feeders, rollers, or moving pin rails 5 through a folding stage 20. Folding stage 20 is the type used to fold one layer of fabric onto itself for generating double biased fabric. Thereby, folding stage 20 is a double biasing unit. For example, as depicted in FIG. 1, folding stage 20 folds fabric 11 from edge 16 over top edge 18 along the centerline 17. Thus, a single biased fabric 11 having edges 16 and 18 with a centerline 17 enters folding stage 20 and exits as a double biased fabric 25 having the previous edges 16 and 18 on top of each other and the previous centerline 17 as a new edge. The specific arrangement shown is merely representative of the invention. It is recognized that the fabric 11 could be folded on the centerline 17 in the other direction with edge 18 being folded onto edge 16. Further, an edge to edge fold on the centerline is not mandatory if a cloth of other orientation is desired. It may be desirable in some instances to fold the fabric only part-way toward either edge.

As shown in FIG. 5, any number of folding stages 20 may be used to produce a biased fabric being other than double biased. For clarity, discussion of like parts shown in FIG. 5 will be omitted, except to say that a plurality of folding stages 20 are depicted therein. Although two such stages are shown, any number may be used to practice the concepts of the instant invention.

In FIG. 1, from folding stage or stages 20, the folded fabric 25 is sent to sewing, stitching, knitting or affixing stage 22. Affixing stage 22 may be of any conventional type sewing or knitting machine, like stage 2. As with stage 2, the affixing stage 22 generally includes a bobbin-carrying mechanism positioned under the fabric 11 providing a different thread for each individual stitching head. At each penetration of the stitching needle from one of the heads, the thread carried by the stitching needle becomes engaged by the thread carried by an associated bobbin beneath the fabric 11. This creates a line of stitching along the length of the fabric. The particular details of the affixing stage 22 have not been shown as they are known in the art.

At this point, zero degree yarn and/or a mat or scrim may be introduced and firmly affixed to the fabric. The mat may be of the type known in the art as a chopped strand mat. Of course, this mat may also be added earlier in the process, such as prior to folding. If desired, this mat may preferably be stitched or sewn or otherwise affixed into or onto the fabric during or after the folding stage as necessary. This mat provides structural integrity. However, if not desired, it is not necessary to add this additional mat, for the resulting fabric of this invention is structurally sound without an additional mat or scrim.

As an alternative to a stitching process, a multiple knitting unit may be used. A knitting operation normally uses a single yarn system, that is, one knitting yarn for each line while the stitching type operation generally involves two yarns per line of stitches. Other differences exist, for example, in the type of needles used that need not be explained further, but either technique may be used. Accordingly, an unknit double biased fabric 25 enters affixing stage 22 and a knit, stitched or sewn double biased fabric 40 exits. Multibiased fabric 40 is then rolled up using an appropriate rolling device 50 in a manner known in the art. A roll of multibiased fabric is formed as a product which may be stored, shipped, or distributed, for example, as necessary.

It is not essential to this invention that the longitudinal secondary yarns be uniformly spaced across the width of the fabric. For example, in the first affixing stage 2, it may be desirable to have a higher density of structural yarns 14 near the edges 16 and 18 and near the centerline 17 of fabric 11. Nor is it essential that the means for affixing the structural yarns be permanently affixed, particularly the affixing means used before folding the single biased fabric to make a multibiased fabric. It may be desirable to use adhesives, frictional belts, resin coatings or saturants or other affixing means which may or may not be removed at a later stage in processing or even upon use in the final product; for example, immediately before or as a result of impregnating with resin in a fiberglass reinforced, resin impregnated composite layer. For the sake of clarity, the secondary affixing means have not been shown after the fabric leaves folding stage 20.

The specific type of carrier or conveyor used to transport the fabric along its path of travel represented by the arrows is also not critical to the invention. Although moving pin rails 5 have been shown in the Figures, another example of an appropriate carrier would be an opposite pair of conveyors which are arranged generally parallel to each other. Typical conveyors known in the art are in the shape of endless belts and are made movable by being mounted so as to extend around driven pulleys. Other types of carrier devices known in the art may be used to convey the fabric.

FIG. 2 depicts a similar apparatus for making the double biased fabric of the invention. Like numerals have been used for like elements as in FIG. 1. The primary difference between the inventive arrangement depicted in FIG. 1 and the inventive arrangement depicted in FIG. 2 is that a single, wide affixing stage 28 is used for knitting, sewing, or otherwise affixing the fabric, and the fabric is fed through the same machine twice, but at different parts of the machine. Biased fabric 10 is shown having structural yarns 12 oriented at an acute angle to the centerline of the fabric. Therefore, this fabric 10 has previously been biased in the manner shown in FIG. 1. Alternatively, the fabric can be skewed in the manner discussed above.

Single biased fabric 10 having edges 16 and 18 and centerline 17 is fed on conveyors, rollers, or moving pin rails 5 to affixing stage 28. On the first pass through machine 28, parallel bias laid structural yarns 12 are optionally sewn, knit or otherwise affixed into a single layer using secondary yarns 14. Affixed single biased fabric 11 made according to the principles discussed above is folded in folding stage 20 using equipment known in the art. The centerline 17 therefore becomes one edge of the folded fabric and the previous edges 16 and 18 lie on top of each other. The thus folded and double biased fabric 25 is led to the input side of affixing stage 28 for a second pass at the other end of machine 28. In this second pass through machine 28 the folded fabric 25 is sewn, knit or affixed again with secondary yarns to hold its two layers together to create a double biased fabric 40.

Thus, after two passes, a knit double biased fabric 40 emerges from affixing stage 28. Multibiased fabric 40 is then rolled up using a suitable rolling device 50 as discussed in the previous embodiment. A roll of multibiased fabric is formed as a product which may be stored, shipped, or distributed, for example, as necessary.

As in the separate stages discussed above, the folding stage 20 folds fabric 11 along its centerline 17 prior to feeding it for a second time through affixing stage 28. Suitable guides (not shown) transport the unstitched fabric between the folding stage 20 and affixing stage 28 in a ribbon-like arrangement 30. Forming a ribbon of fabric in a continuous process is known in the art. Suitable spacing must be maintained so as to avoid bunching or even stretching. Accordingly, appropriate tensioners are also provided.

This arrangement provides for a parallel knitting path as opposed to one in series. A parallel path may be necessary when longitudinal space constraints are imposed such as when certain processing steps must be limited to certain physical areas, not an uncommon occurrence in industrial plants. Moreover, the arrangement of FIG. 2 makes possible the creation of a double biased fabric from one affixing machine in a continuous process. There is no need to roll up the intermediate single biased fabric, and then unroll it on the second pass through the same machine.

In a preferred embodiment of the apparatus depicted in FIG. 2, the biased fabric 10 supported on pin rails 5, for example, is fed to affixing stage 28. Optional affixing of the single biased fabric by stitching, sewing or knitting can be done on the first 65%, for example, of the knitting bed of affixing stage 28. Generally, the stitching will have fairly wide spacing such as four and one half inch spacing with approximately six to twelve courses per inch.

Single biased fabric 11 made according to the principles discussed above is then fed into folding stage 20 which folds the fabric onto itself in the manner described with respect to FIG. 1. Folding stage 20 doubles the fabric to half its width. As shown in FIG. 2, folding stage 20 is oriented in series with affixing stage 28. However, it is within the scope of the invention to orient the folding stage 20 at right angles to the affixing stage 28 as discussed below with respect to FIGS. 3A and 3B. In folding stage 20, special equipment which is standard in the art is used to ensure that the two extremes of the original fabric continue to locate directly on each other if it is desired to fold the fabric precisely in half.

The unstitched double biased fabric 11 is then fed via suitable rollers and/or tensioners (not shown) in ribbon-like form 30 back to the unused 35%, for example, of the knitting bed of affixing stage 28. Thus, the second stage of knitting occurs in the same stitching machine.

At this point, zero degree yarn and/or a mat or scrim may be introduced and firmly affixed to the fabric. The mat may be of the type known in the art as a chopped strand mat. Of course, this mat may also be added earlier in the process, such as prior to folding. If desired, this mat may preferably be stitched or sewn into or onto the fabric during or after the second stitching stage as necessary. This mat provides structural integrity. However, if not desired, it is not necessary to add this additional mat, for the resulting fabric of the instant invention is structurally sound without an additional mat or scrim.

The percentages of knitting bed discussed for each pass through the affixing stage 28 are merely exemplary as any percentage necessary may be used in applying the inventive concepts discussed herein.

Figure 3A:
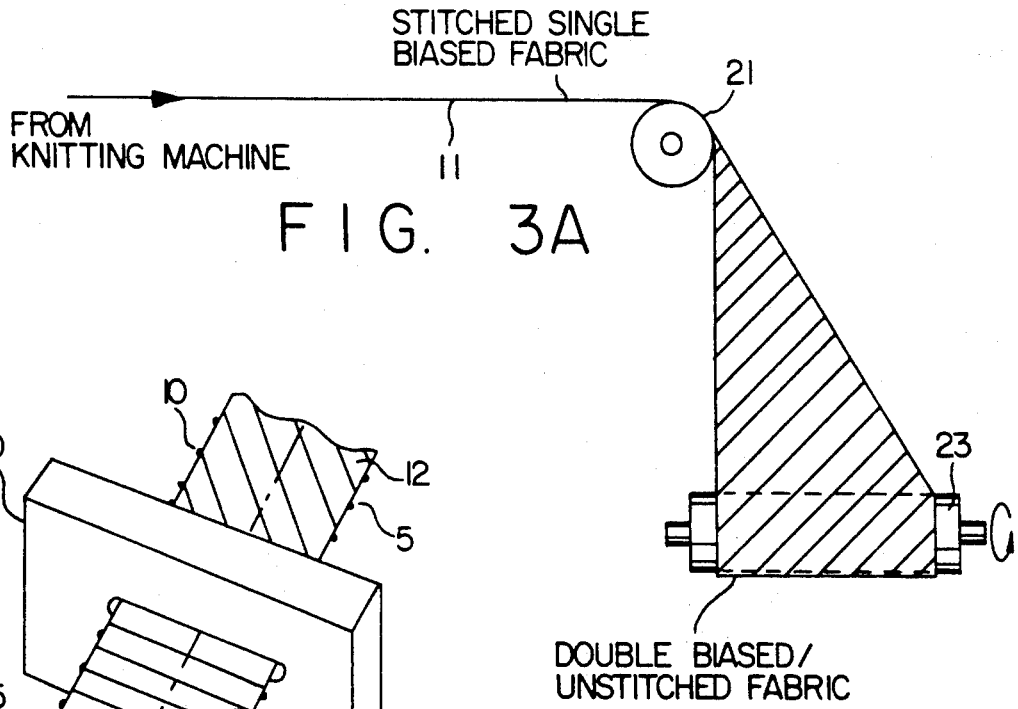
FIG. 3A is a side view of a preferred folding stage, double biasing unit.
Figure 3B:
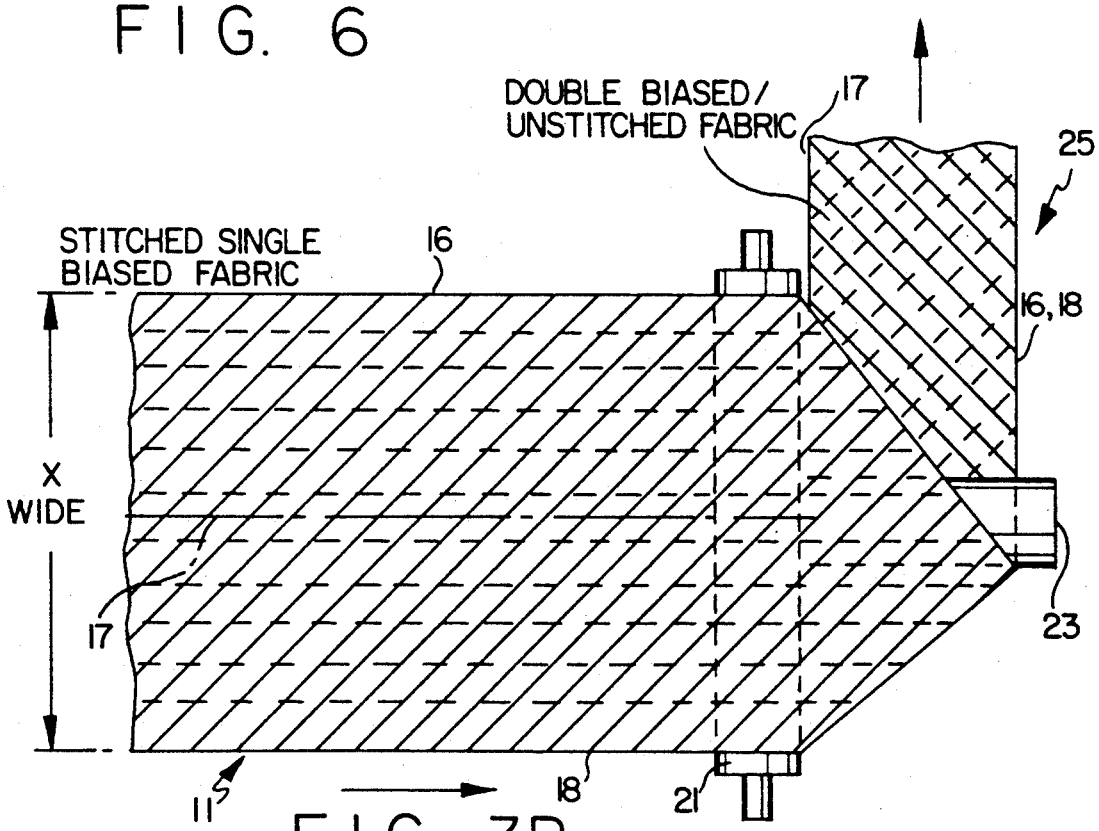
FIG. 3B is a plan view of the preferred folding stage, double biasing unit.

FIG. 3A represents a side view of a folding stage, double biasing unit. Stitched single biased fabric 11 having a centerline 17 shown in plan view FIG. 3B is fed from the affixing stage 2 of FIG. 1 or affixing stage 20 of FIG. 2 or directly, if the skewing method is implemented, over rollers 21 to folding stage 23 which acts as a double biasing unit by folding edge 16 of the fabric 11 onto edge 18 as in the previous embodiments. The resultant fabric 25 is double biased having new edges 17 and 16, 18. This fabric 25 is then sent to a subsequent affixing stage. The subsequent affixing stage may be in-line as affixing stage 22 depicted in FIG. 1 or the second stage may be the remainder of the knitting bed of the one affixing stage 28 as depicted in FIG. 2. The stitched, single biased fabric 11 is thereby folded in half utilizing the double biasing unit 23. The double biased, unstitched fabric is then fed to further stitching stages as discussed with respect to the previous embodiments.

Certainly other flow paths are envisioned within the inventive concepts of this invention.

FIG. 4 depicts a double biased fabric 40 in accordance with this invention. The fabric 40 has a diamond shaped pattern 42 due to the overlapping of the single biased fabric 11 The diamond portions 42 consist of triangular portions 44. The yarns 46 of the top layer of each diamond portion 42 are illustrated as solid lines and the yarns 48 of the bottom layer are depicted as dashed lines. It will be observed that the yarns 46 forming the top layer of one of the diamond portions 42 extend into and form the bottom layer of an adjacent triangular portion 44. Conversely, the yarns 48 forming the bottom layer of a given triangular portion 44 extend into and form the top layer of an adjacent triangular portion.

The double biased fabric 40 depicted in FIG. 4 results in a fabric having the uniformity of the two layer, one vertical knit method as discussed with respect to the related art by using less equipment in an arrangement that is much less complicated, resulting in a process that is less expensive. Furthermore, the double biased fabric of the instant invention results in a much more uniform fabric than that achieved by the complicated skewing process previously known in the prior art. Accordingly, the double biased fabric and method of making disclosed by the present invention offer many advantages over prior art techniques.

In the above embodiments, structural yarns parallel to the length of the fabric may also be added to the double biased fabric described above to make a tri-axial fabric. These lengthwise structural yarns may be added during the course of either affixing stage using methods well known in the art.

As indicated above, the processes are merely representative of those which could be used to create various fabrics in accordance with the present invention. Not only the fabrics, but also the processes disclosed are illustrative only. The foregoing detailed description is not intended to be limiting as to the scope of the invention. Modifications and variations are contemplated within the present invention, which is intended to be limited only by the scope of the accompanying claims.

What is claimed is:

1. A method of making a multi-layer non-woven multiple biased fabric comprising the steps of:

directing a layer of single biased structural fabric in a longitudinal direction of travel, wherein the layer of fabric is comprised of a plurality of structural fibers oriented substantially parallel to each other at an acute angle to the longitudinal centerline of the fabric;

leading the single biased fabric layer into a folding stage for folding the biased layer longitudinally from one edge toward another to form a multiple biased fabric;

leading the multiple biased fabric into an affixing stage for affixing the multiple biased fabric together to provide a single structural fabric being multiple biased.

2. The method of claim 1, wherein the multiple biased fabric is double biased.

3. The method of claim 1, wherein the folding stage and the affixing stage are oriented in series in the direction of travel of the fabric.

4. The method of claim 1, wherein the fabric is affixed by secondary yarns.

5. The method of claim 4, wherein the secondary yarns are non-structural yarns.

6. The method of claim 1, wherein the structural fibers of the single biased fabric are oriented at 45 degrees from each edge.

7. The method of claim 3, wherein the structural fibers of the double biased fabric are perpendicular to one another.

8. The method of claim 1, further comprising folding the fabric in a plurality of the folding stages.

9. The method of claim 1, further comprising adding parallel yarns arranged longitudinally in the layer of fabric.

10. A method of making a multi-layer non-woven multiple biased fabric comprising the steps of:

directing a layer of fabric in a longitudinal direction of travel, wherein the layer of fabric is comprised of a plurality of structural fibers oriented substantially parallel to each other and oriented substantially orthogonally to the longitudinal centerline of the fabric;

biasing the structural fibers of the fabric in a biasing stage to form a layer of single biased structural fabric having the structural fibers biased to the fabric centerline;

leading the biased layer into at least one folding stage for folding the biased layer longitudinally from one edge toward another to form a multiple biased fabric;

leading the multiple biased fabric from the at least one folding stage into an affixing stage for affixing the multiple biased fabric together to provide a single structural fabric being multiple biased.

11. The method of claim 10, further comprising leading the biased layer to an affixing stage for affixing the structural fibers in alignment prior to folding the fabric in the folding step.

12. The method of claim 10, wherein the biasing step comprises laying and affixing the structural fibers at an angle to the edges of the fabric.

13. The method of claim 10, wherein the biasing step comprises skewing the structural fibers at an angle to the edges of the fabric.

14. The method of claim 10, wherein the multiple biased fabric is double biased.

15. The method of claim 10, wherein the folding stage and the affixing stage are oriented in series in the direction of travel of the fabric.

16. The method of claim 11, wherein the first affixing stage and the second affixing stage are oriented in parallel in the direction of travel of said fabric.

17. The method of claim 10, wherein the fabric is affixed by secondary yarns.

18. The method of claim 17, wherein the secondary yarns are non-structural yarns.

19. The method of claim 10, wherein the structural fibers of the single biased fabric are oriented at 45 degrees from each edge.

20. The method of claim 14, wherein the structural fibers of the double biased fabric are perpendicular to one another.

21. The method of claim 10, further comprising folding the fabric in a plurality of the folding stages.

22. The method of claim 10, further comprising adding parallel yarns arranged longitudinally in the layer of fabric.

* * * * *